US006748783B1

(12) United States Patent
Chubb et al.

(10) Patent No.: US 6,748,783 B1
(45) Date of Patent: Jun. 15, 2004

(54) BEND/CUT-OFF GAUGE FOR A PORTABLE SHEET BENDING BRAKE

(75) Inventors: Arthur Bryant Chubb, Dexter, MI (US); Norman Chubb, Carlton, MI (US); James E. Suyak, Dexter, MI (US); Arthur Bryant Chubb, II, Pinckney, MI (US)

(73) Assignee: J-Dan, Romulus, MI (US)

( * ) Notice: Subject to any disclaimer, the term of this patent is extended or adjusted under 35 U.S.C. 154(b) by 0 days.

(21) Appl. No.: 10/283,872

(22) Filed: Oct. 30, 2002

(51) Int. Cl.[7] ..... B21D 5/04
(52) U.S. Cl. ..... 72/294; 72/319; 72/461
(58) Field of Search ..... 72/294, 319, 320, 72/461; 33/201

(56) References Cited

U.S. PATENT DOCUMENTS

| | | | | |
|---|---|---|---|---|
| 5,259,230 A | * | 11/1993 | Beyers | 72/294 |
| 5,582,053 A | | 12/1996 | Chubb | 72/294 |
| 5,630,336 A | * | 5/1997 | Jorgenson | 72/319 |
| 5,706,692 A | | 1/1998 | Chubb | 72/294 |
| 5,761,939 A | | 6/1998 | Spencer | 72/319 |
| 6,000,268 A | | 12/1999 | Van Cleave | 72/294 |
| 6,408,527 B1 | * | 6/2002 | Chubb | 33/42 |

* cited by examiner

*Primary Examiner*—Daniel C. Crane
(74) *Attorney, Agent, or Firm*—Reising, Ethington, Barnes, Kisselle, P.C.

(57) ABSTRACT

A bend/cut-off gauge includes a hanger having a first portion adapted to engage at least one track feature on the anvil member of a sheet bending brake, and a second portion extending from the first portion so as to be cantilevered from the anvil member adjacent to the sheet material clamp surface on the base member of the brake. An abutment stop is disposed on the second portion of the hanger for engagement by an edge of sheet material resting on the clamp surface. The width of the sheet material between the edge of the anvil member and the abutment stop is thus accurately gauged. The gauge may then be removed from the anvil member, and the bend member operated to bend an accurately gauged strip of material over the anvil member, or the cutter mechanism operated along the track feature(s) on the anvil member to sever an accurately gauged strip of material from the sheet stock clamped between the anvil member and the base member.

18 Claims, 3 Drawing Sheets

BEND/CUT-OFF GAUGE FOR A PORTABLE SHEET BENDING BRAKE

The present invention is directed to portable sheet bending brakes of the type having one or more track features for guiding a mechanism to cut sheet material clamped in the brake, and more particularly to a gauge for locating the edge of the sheet material with respect to the brake for accurate bending by the brake or cutting by the cut-off mechanism.

BACKGROUND AND SUMMARY OF THE INVENTION

Portable sheet bending brakes generally include a support frame with a plurality of C-shaped frame sections. An elongated base member is mounted on the lower arms of the frame sections to form a clamp surface, and an elongated anvil member is mounted on bars pivotally secured to the upper arms of the frame sections for clamping sheet material against the clamp surface on the base member. A bend member is pivotally mounted to the base member for bending over an edge of the anvil member sheet material clamped between the anvil member and the base member. The anvil member is provided with one or more longitudinally extending track features for guiding a manual cutter mechanism along the anvil member so as to slice strips of material from sheet stock clamped between the anvil and base members. A general object of the present invention is to provide a gauge for accurately locating the sheet material prior to a bending or cutting operation.

It has been proposed to provide an indexing mechanism between C-shaped members of the bending brake, that is on the back side of the base and anvil members with reference to the front side of the brake at which bending occurs. These index mechanisms are expensive, are difficult to adjust in the field, and are not as accurate as desired. Another and more specific object of the present invention is to provide a bend/cut-off gauge for a portable sheet bending brake that is employed on the front or working side of the brake, that is inexpensive, that is easy to use, and that provides an accurate and direct measure of the width of the strip material that is to be bent or severed.

A bend/cut-off gauge in accordance with an exemplary but presently preferred embodiment of the invention includes a hanger having a first portion adapted to engage at least one track feature on the anvil member of a sheet bending brake, and a second portion extending from the first portion so as to be cantilevered from the anvil member adjacent to the sheet material clamp surface on the base member of the brake. An abutment stop is disposed on the second portion of the hanger for engagement by an edge of sheet material resting on the clamp surface. The width of the sheet material between the edge of the anvil member and the abutment stop is thus accurately gauged. The gauge may then be removed from the anvil member, and the bend member operated to bend an accurately gauged strip of material over the anvil member, or the cutter mechanism operated along the track feature(s) on the anvil member to sever an accurately gauged strip of material from the sheet stock clamped between the anvil member and the base member.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
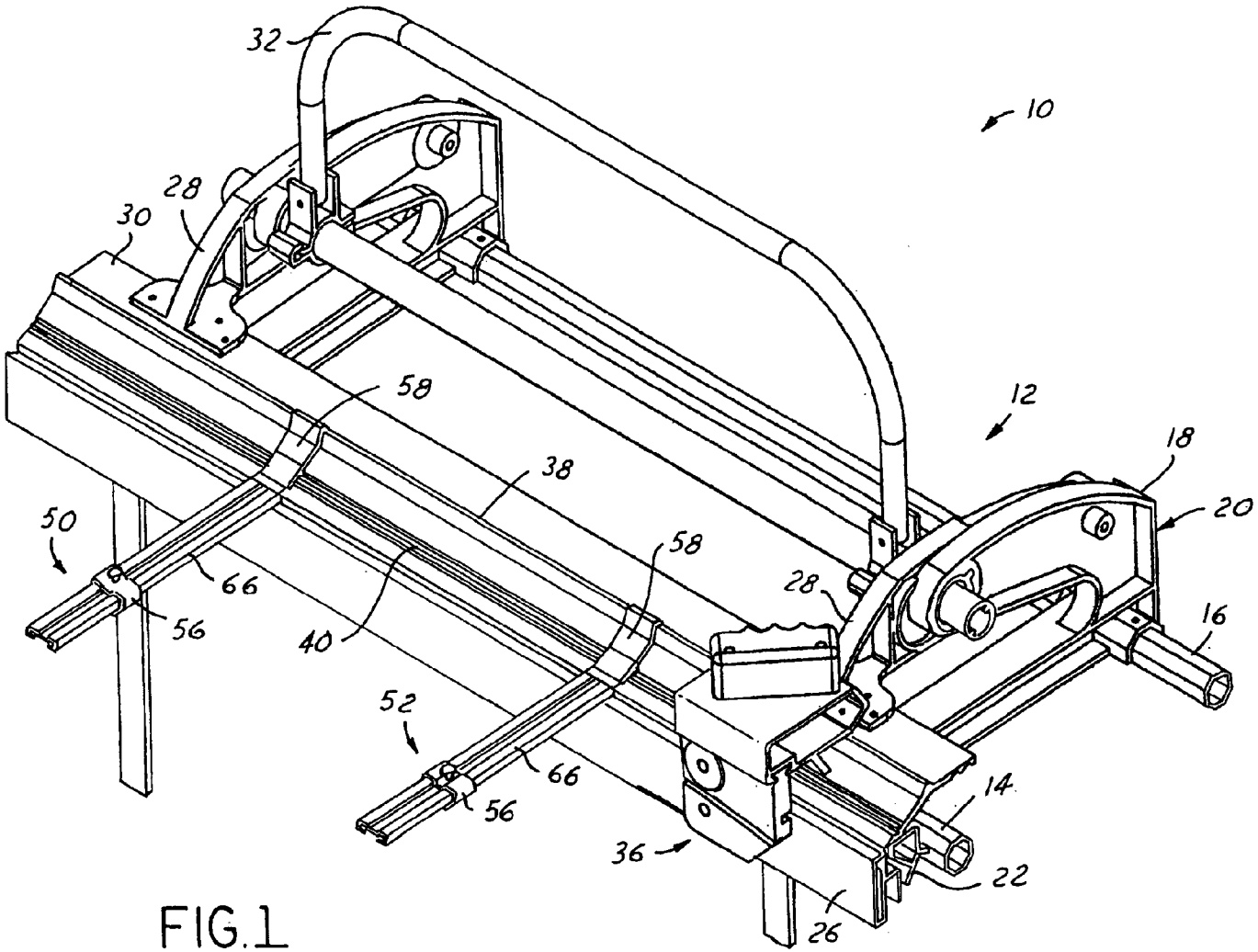
FIG. 1 is a front perspective view of a sheet bending brake and bend/cut-off gauge in accordance with one exemplary embodiment of the invention.
Figure 2:
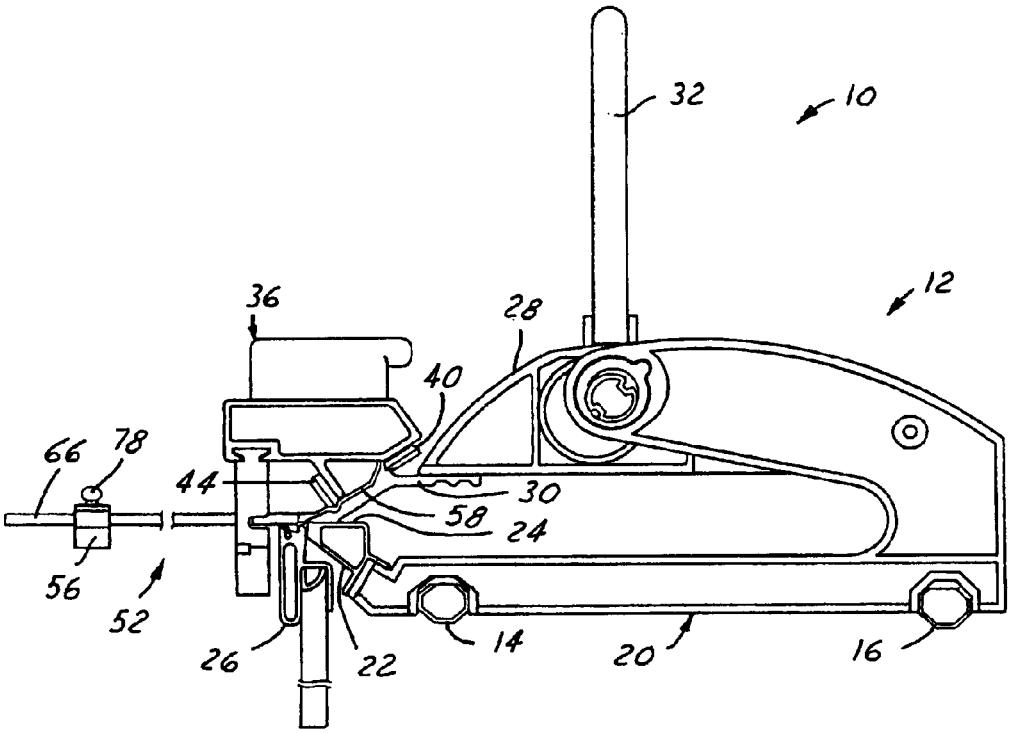
FIG. 2 is an end elevational view of the gauge and brake combination illustrated in FIG. 1.
Figure 3:
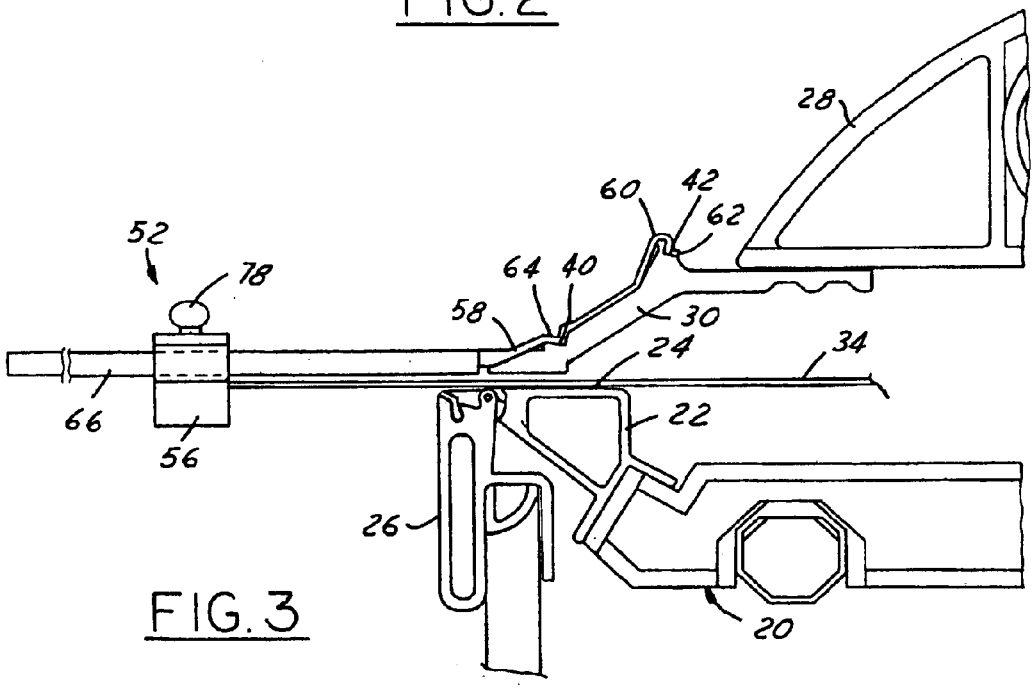
FIG. 3 is a fragmentary view on an enlarged scale of a portion of the combination illustrated in FIG. 2.
Figures 4, 5:
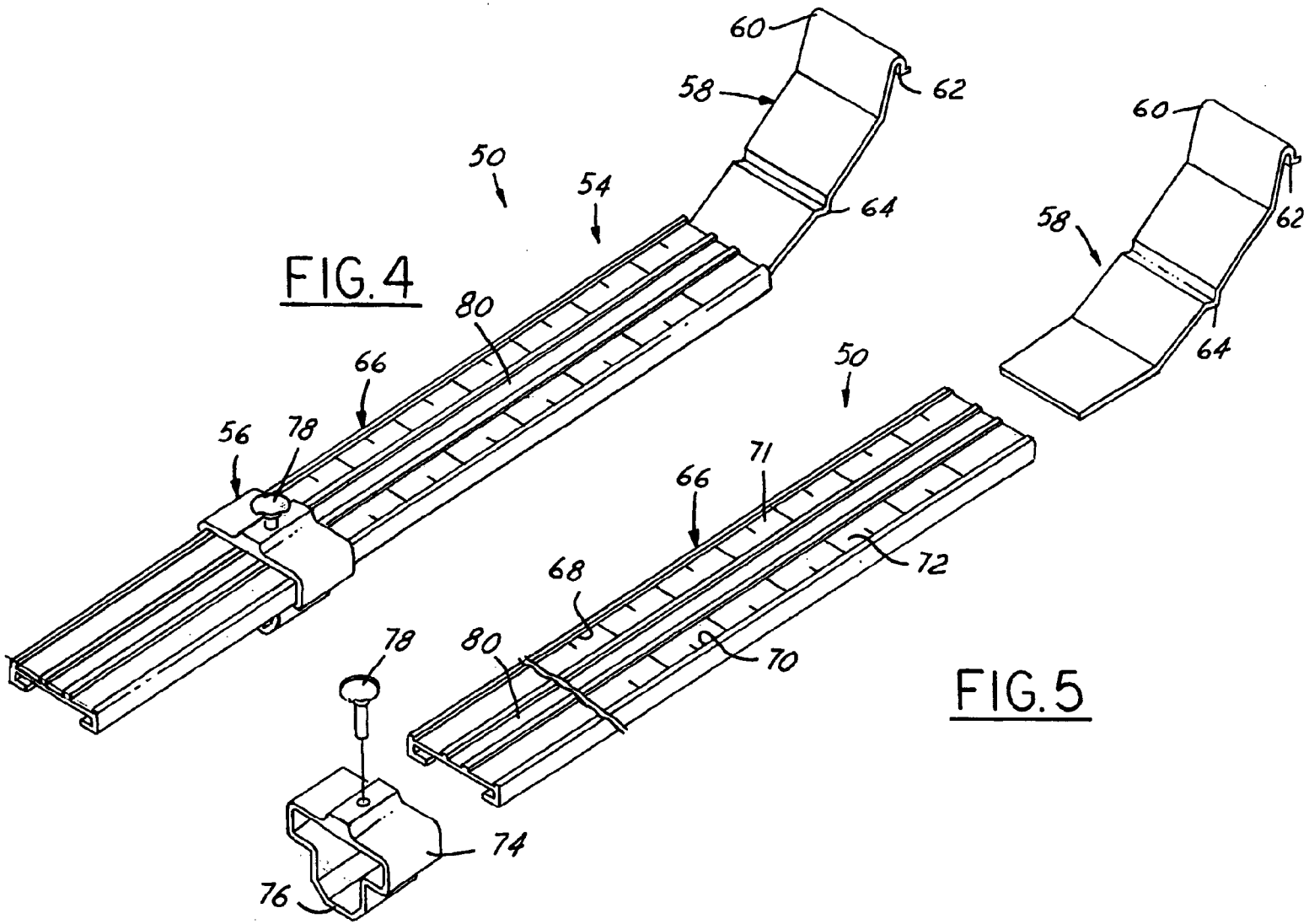
FIG. 4 is a perspective view of the bend/cut-off gauge illustrated in FIGS. 1–3.
FIG. 5 is an exploded perspective view of the gauge illustrated in FIG. 4.

FIGS. 1–3 illustrate a bend/cut-off gauge and portable sheet bending brake combination 10 in accordance with one exemplary but presently preferred embodiment of the invention. A portable sheet bending brake 12 includes elongated front and rear rails 14, 16. A plurality of frame sections 18 are disposed in a longitudinally spaced array and secured to rails 14, 16. Rails 14, 16 and frame sections 18 thus form a rigid elongated generally rectangular support frame 20, in which frame sections 18 hold rails 14, 16 in spaced apart parallel position. Each frame section 18 is generally C-shaped in lateral view (FIG. 2). An elongated base member 22 is secured to the forward edge of the lower arms of the several frame sections 18. Base member 22 has a flat upper surface 24 that forms a clamp surface for sheet material. An elongated bend member 26 is pivotally mounted by a hinge rod to base member 22 at a position adjacent to the forward edge of clamp surface 24. A bar or arm 28 is pivotally mounted to the upper arm of each frame section 18. An elongated anvil member 30 interconnects the forward ends of the several arms 28. A handle 32 is pivotally mounted on frame sections 18 for moving anvil member 30 toward and away from clamp surface 24 of base member 22 selectively to clamp sheet stock 34 (FIG. 3) between anvil member 30 and base member 22. With sheet material clamped between anvil 30 and base member 22, bend member 26 may be pivoted upwardly by an operator to bend the sheet material over the forward edge of anvil member 30.

An illustrative sheet bending brake 12 is disclosed in U.S. application Ser. No. 09/793,062 filed Feb. 26, 2001.

Anvil member 30 includes one or more elongated parallel track features for receiving and guiding a cut-off mechanism or cutter 36. As best seen in FIGS. 2 and 3, these track features in the illustrated implementation of the brake include a pair of parallel track channels 40, 42 that extend longitudinally of the anvil member and are spaced from each other laterally of the anvil member. Cutter 36 illustrated in the drawings includes sets of rollers 44, 46 with external V-shaped peripheries for receipt in track grooves or channels 40, 42 to guide cutter 36 along anvil member 30. A pair of opposed rollers on cutter 36 sever a strip from the outer edge of sheet material 34. Because of the design of the cutter, the material is severed at a predetermined spacing from the front edge of the anvil member, typically one and one-half inches in the art. The particular cutter 36 illustrated in the drawings is the subject of concurrently filed U.S. application Ser. No. 10/283,556, which is presently preferred. However, the principles of the cut-off gauge to be described apply equally as well to other cutter/track arrangements having one or more longitudinal track features along the anvil member of the bending brake, such as are illustrated for example in U.S. Pat. Nos. 5,582,053, 5,706,693 or 6,000,268.

Gauge and brake combination 10 illustrated in the drawings includes a pair of bend/cut-off gauges 50, 52. These gauges preferably are identical, and gauge 50 will be described in detail. Gauge 50 includes a hanger 54 and an abutment stop 56. Hanger 54 has a first portion 58 with a hook 60, a bead 62 and a bead 64 adapted to engage track features 40, 42 on anvil member 30 (FIGS. 1–3) to cantilever gauge 50 from the anvil member. Bead 62 is formed adjacent to the free end of hook 60 for receipt in track channel 42 (FIG. 3). Bead 64 is formed in the mid portion of hanger first portion 58 for receipt in track channel 40 on anvil member 30. A second portion 66 of hanger 54 is received over an end of first portion 58, and is secured to first portion 58 by suitable means, such as adhesive or crimping. Second portion 66 may be an elongated extrusion having at least one slot, and preferably a pair of parallel slots 68, 70, extending along the length of the second portion so as to be cantilevered from first portion 58 and perpendicular to the bend edge of anvil member 30 in assembly. A pair of scales 71, 72 are respectively disposed in slots 68, 70. In the preferred embodiment of the invention, scale 71 measures from the bend edge of anvil member 30 in assembly, while scale 72 measures from a predetermined spaying from the anvil edge, such as the one and one-half inches that forms the typical spacing between the anvil edge and the cut edge of the sheet material typical in the art. Abutment stop 56 is of generally T-shaped construction, having an upper section 74 for slidable receipt over portion 66 of hanger 54, and a lower section 76 that generally aligns with clamp surface 64 in assembly (FIGS. 2 and 3) and at a position to be engaged by the free edge of sheet material 34. A screw 78 extends through upper section 74 of abutment stop 56, and cooperates with a channel 80 in hanger portion 66 between slots 68, 70 for selectively locking abutment stop 56 in position. Other locking means, including manual cams for example, may be employed.

In use, abutment stops 56 are first manually positioned with respect to scale 71 or 72. Stops 56 of both gauges 50, 52 (FIG. 1) would typically be set at the same position, such as a position of eight inches on scale 71. With sheet material 34 between anvil member 30 and base member 22, but with the anvil member unclamped (FIG. 3), gauges 50, 52 are positioned at longitudinally spaced positions on anvil member 30. Sheet material 34 is then pulled outwardly to a position in engagement with stops 56 on both gauges, and the sheet material is then clamped in position by operation of handle 32. Gauges 50, 52 are removed. To perform a bend operation, bend member 26 is pivoted upwardly to bend an accurately gauged width of the sheet material over the forward edge of the anvil member. Alternatively, where gauges 50, 52 are employed as cut-off gauges, cutter 36 is operated along the length of the anvil member to sever a strip of sheet material of a width determined by the positions of stops 56. Handle 32 can be released, gauges 50, 52 repositioned on anvil member 30, and the sheet material within the brake again repositioned so that the forward edge of the sheet material engages stops 56. Handle 32 may then be relocked, gauges 50, 52 removed, and bend member 26 or cutter 36 again operated to bend or sever another length of sheet material. This process can be repeated as often as needed to provide lengths of sheet stock of desired width. In the event that different widths or bends are desired, abutment stops 56 can be repositioned on gauges 50, 52.

Abutment stops 56, hanger portions 58 and hanger portions 66 preferably are of extruded metal construction, such as aluminum. However, inasmuch as these elements bear little load, they could as well be of plastic or other suitable construction. Gauge portions 58, 66 may be of integral construction, although a two-piece construction is preferred as shown.

There have thus been described bend/cut-off gauge for a portable sheet bending brake, and a gauge/brake combination, that fully satisfy all of the objects and aims previously set forth. The invention has been described in conjunction a presently preferred embodiment thereof, and a number of modifications and variations have been discussed. Although the bend/cut-off gauge illustrated in the drawings and discussed above is adapted for use on a bending brake having specific track features, the gauge can be readily modified for use in connection with brakes having other track features by simply redesigning first gauge portion 58. Abutment stop 56 could be affixed to gauge portion 66 and the gauges could be provided in various sizes, although adjustable gauges are preferred. Other modifications and variations-will readily suggest themselves to persons of ordinary skill in the art. The invention is intended to embrace all such modifications and variations as fall within the spirit and broad scope of the appended claims.

What is claimed is:

1. A bend/cut-off gauge for a portable sheet bending brake that includes a base member having a clamp surface, an anvil member for clamping sheet material against the clamp surface, the anvil member having at least one longitudinally extending track feature for guiding a cut-off mechanism along the anvil member, and a bend member for bending sheet material over the anvil member, said bend/cut-off gauge including:

a hanger having a first portion adapted to engage the at least one track feature on the anvil member, and a second portion extending from said first portion so as to be cantilevered from the anvil member adjacent to the clamp surface, and an abutment stop adjustably positionable on said second portion of said hanger for engagement by an edge of sheet material resting on the clamp surface.

2. The gauge set forth in claim 1 wherein said second portion of said hanger includes at least one scale for measuring position of said adjustable stop with respect to the anvil member.

3. The gauge set forth in claim 2 wherein said second portion of said hanger includes a pair of said scales, a first of said scales indicating position with respect to an adjacent edge of the anvil member and a second of said scales indicating position with respect to a predetermined spacing from the adjacent edge of the anvil member.

4. The gauge set forth in claim 1 wherein said abutment stop includes a lock for locking said abutment stop at a desired position on said second portion of said hanger.

5. The gauge set forth in claim 4 wherein said lock comprises a screw lock.

6. The gauge set forth in claim 1 wherein the anvil member has a pair of parallel track features, and said first portion of said hanger includes portions for engaging both of said track features to stabilize said hanger on the anvil member.

7. The gauge set forth in claim 6 wherein the track features on the anvil member include parallel longitudinal channels, and wherein said first portion of said hanger includes a pair of beads for receipt in the channels on the anvil member.

8. A bend/cut-off gauge for a portable sheet bending brake that includes a base member having a clamp surface, an anvil member for clamping sheet material against the clamp surface, the anvil member having a pair of longitudinally extending parallel track feature channels for guiding a cut-off mechanism along the anvil member, and a bend member for bending sheet material over the anvil member, said bend/cut-off gauge including:

a hanger having a first portion with a pair of beads adapted for receipt in said track feature channels on the anvil member to stabilize said hanger on the anvil member, and a second portion extending from said first portion so as to be cantilevered from the anvil member adjacent to the clamp surface, and an abutment stop on said second portion of said hanger for engagement by an edge of sheet material resting on the clamp surface.

9. The gauge set forth in claim 8 wherein said abutment stop is adjustably positionable on said second portion of said hanger.

10. A bend/cut-off gauge and portable sheet bending brake combination that includes:

a base member having a clamp surface, an anvil member movable toward and away from said base member for clamping sheet material against said clamp surface, said anvil member having at least one longitudinal track feature for guiding a cut-off mechanism along said anvil member, a bend member pivotally mounted on said base member for bending over an edge of said anvil member sheet material clamped between said base and anvil members, and a pair of bend/cut-off gauges for adjustable and removable securement to said anvil member for indexing an edge of sheet material in spaced relation to said edge of said anvil member, each of said bend/cut-off gauges including:

a hanger having a first portion adapted to engage said at least one track feature, and a second portion extending from said first portion so as to be cantilevered from said anvil member adjacent to said clamp surface, and an abutment stop adjustably positionable on said second portion of said hanger for engagement by an edge of sheet material resting on said clamp surface.

11. The combination set forth in claim 10 wherein said second portion of said hanger includes at least one scale for measuring position of said adjustable stop with respect to said anvil member.

12. The combination set forth in claim 11 wherein said second portion of said hanger includes a pair of said scales, a first of said scales indicating position with respect to an adjacent edge of said anvil member and a second of said scales indicating position with respect to a predetermined spacing from the adjacent edge of said anvil member.

13. The combination set forth in claim 10 wherein said abutment stop includes a lock for locking said abutment stop at a desired position on said second portion of said hanger.

14. The combination set forth in claim 13 wherein said lock comprises a screw lock.

15. The combination set forth in claim 10 wherein said anvil member has a pair of parallel track features, and said first portion of said hanger includes portions for engaging both of said track features to stabilize said hanger on said anvil member.

16. The combination set forth in claim 15 wherein the track features on the anvil member include parallel longitudinal channels, and wherein said first portion of said hanger includes a pair of beads for receipt in the channels.

17. A bend/cut-off gauge and portable sheet bending brake combination that includes:

a base member having a clamp surface, an anvil member movable toward and away from said base member for clamping sheet material against said clamp surface, said anvil member having a pair of longitudinal parallel track feature channels for guiding a cut-off mechanism along said anvil member, a bend member pivotally mounted on said base member for bending over an edge of said anvil member sheet material clamped between said base and anvil members, and a pair of bend/cut-off gauges for adjustable and removable securement to said anvil member for indexing an edge of sheet material in spaced relation to said edge of said anvil member, each of said bend/cut-off gauges including:

a hanger having a first portion with a pair of beads adapted for receipt in said track feature channels to stabilize said hanger on said anvil member, and a second portion extending from said first portion so as to be cantilevered from said anvil member adjacent to said clamp surface, and an abutment stop on said second portion of said hanger for engagement by an edge of sheet material resting on said clamp surface.

18. The combination set forth in claim 17 wherein said abutment stop is adjustably positionable on said second portion of said hanger.

* * * * *